US005311624A

United States Patent [19]

Hutchinson

[11] Patent Number: 5,311,624

[45] Date of Patent: May 17, 1994

[54] MATTRESS HAVING 2-PLY MOISTURE BARRIER AND REPLACEABLE UPHOLSTERY

[75] Inventor: Ronald G. Hutchinson, Dunwoody, Ga.

[73] Assignee: Simmons Company, Atlanta, Ga.

[21] Appl. No.: 25,022

[22] Filed: Mar. 1, 1993

[51] Int. Cl.[5] ..... A47C 27/045; A47C 27/04

[52] U.S. Cl. ..... 5/478; 5/471; 5/473; 5/475; 428/68; 428/284; 428/286

[58] Field of Search ..... 5/475, 477, 473, 476, 5/478, 471; 428/64, 284, 286

[56] References Cited

U.S. PATENT DOCUMENTS 3,493,980 2/1970 Haller ..... 5/478

4,809,375 3/1989 Bull ..... 5/473

*Primary Examiner*—Alexander Grosz

*Attorney, Agent, or Firm*—Jones & Askew

[57] ABSTRACT

An innerspring mattress construction is provided which includes a laminated liquid or moisture barrier layer which itself provides improved attachment properties. Also provided is a water mattress construction having improved resistance to leakage. Also provided is an improved pocketed coil construction which is resistant to moisture.

17 Claims, 2 Drawing Sheets

MATTRESS HAVING 2-PLY MOISTURE BARRIER AND REPLACEABLE UPHOLSTERY

TECHNICAL FIELD

This invention relates in general to mattresses, and in particular relates to innerspring mattresses having removable and replaceable covers. This invention also particularly relates to water mattresses, as well as individual pocketed coil constructions.

BACKGROUND OF THE INVENTION

In the mattress industry, it is well known that in certain mattress environments there is need to provide water, water vapor, or other liquid, vapor, or moisture barriers in order to prevent same from undesirably seeping or passing into certain portions of the mattress, or from passing out of the mattress. In the case of an innerspring mattress, particularly in hospitals or other health care environments, there is a need to prevent water, urine, or other liquids from passing through the upholstered cover of the mattress and into the innerspring portion of the mattress. Once within the area of the innerspring portion of the mattress, fluids are difficult to remove and can cause rusting or other undesirable effects.

In the instance of water mattresses, there is also a need to prevent the water within the water mattress from leaking into the cover of the mattress should a water bladder break or tear in some manner, and there is also a need to provide a vapor barrier between the water bladder(s) and the user.

Water-resistant materials have been used so as to provide a liquid or vapor barrier, but to date these barriers have been found ineffective in that some barrier material (such as a vinyl) is difficult to sew or otherwise fasten within the mattress. Another particular difficulty is that of tearing or ripping of the barrier material.

Therefore a need has been recognized for a mattress construction which provides a water or other liquid barrier, but also is resistant to tearing during manufacture or use of the mattress. A need has also been recognized to provide an improved water mattress construction which has improved resistance to interior water leakage and providing a vapor barrier. A need has also been recognized to provide a pocketed coil construction which has liquid- or moisture-resistant characteristics.

SUMMARY OF THE INVENTION

The present invention solves deficiencies in the prior art by providing a mattress construction which includes a moisture barrier material which is suitable for fastening within a mattress with a minimum of tearing or ripping. The present invention also provides a water mattress construction which includes improved resistance to leakage from within. The present invention also provides an improved pocketed coil construction.

Generally described, the present invention provides a mattress construction, comprising an innerspring construction defining an upper primary planar surface and including at least one spring, a laminated liquid barrier layer itself comprising a liquid-impervious layer, and a structural backing, attachment means for attaching the laminated liquid barrier layer to the innerspring construction, and a cover. The invention also provides a water mattress construction, comprising a base defining a cavity and an upper opening, a water bladder contained within the cavity at the base, a top cover, and a moisture barrier attached to the underside of the top. Finally, the invention provides a pocketed coil construction, comprising a spring, and a laminated pocketing cover itself comprising a moisture barrier layer and a fabric layer.

Therefore, it is an object of the present invention to provide an improved mattress construction.

It is a further object of the present invention to provide a mattress construction which includes a water, water vapor, or other liquid or vapor barrier.

It is a further object of the present invention to provide an improved water mattress construction which provides resistance to interior water leakage and also provides a vapor barrier.

It is a further object of the present invention to provide an improved mattress construction which includes a removable cover. It is a further object of the present invention to provide an improved pocketed coil construction.

Other objects, features, and advantages of the present invention will become apparent upon reading the following detailed description of the preferred embodiment of the invention when taken in conjunction with the drawing and the appended claims.

DETAILED DESCRIPTION OF THE PREFERRED EMBODIMENT

Referring now to the figures, in which like numerals designate like elements throughout the several views, FIGS. 1–5 illustrate various embodiments including the present invention.

Figure 1:
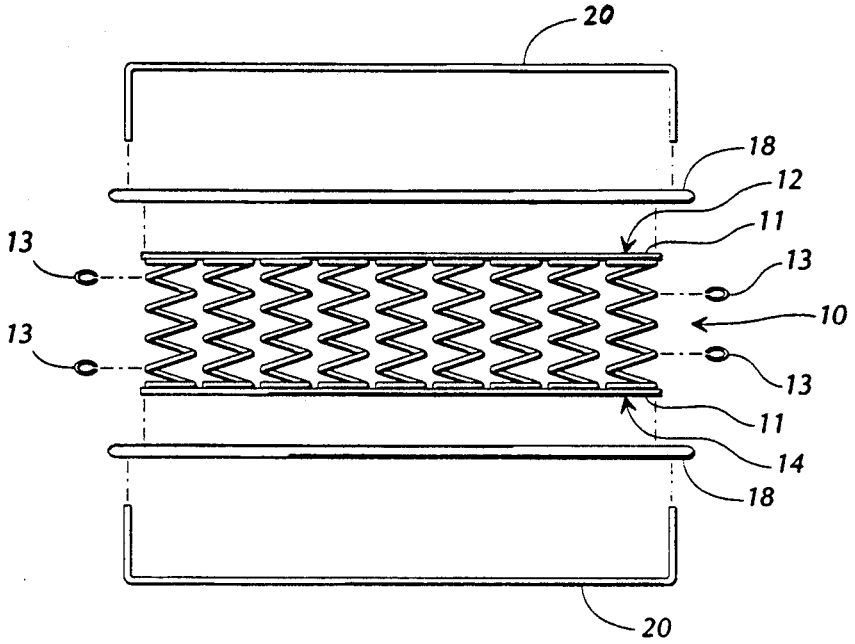
FIG. 1 is an end, exploded illustrative view of an innerspring construction, padding layers, and barrier layers according to the present invention.

FIG. 1 illustrates the present invention used in an innerspring environment. As may be seen, an innerspring construction 10 includes a pair of border wires 11, and defines a top surface 12 a bottom surface 14, and sides. This innerspring construction may be an open-coil construction as illustrated, or may also be a pocketed-coil type as identified in U.S. Pat. No. 4,234,933 to Stumpf, hereby incorporated by reference.

An upholstery layer or layers 18 may be placed upon the top and bottom surfaces of the innerspring construction, such that the layer 18 overlaps the border wires. This upholstery layer may include an insulating layer (such as fiber padding or plastic netting) and may also include cotton fiber padding, polyurethane padding, or other padding materials known in the art. Upon each upholstery layer 18, a layer of laminated barrier material 20 (described in further detail below) is "hog-ringed" by hog rings 13 directly to the springs 22 of the innerspring construction. In the preferred embodiment, the barrier material is shown "hog-ringed" to the second available convolution (including the base ring) of the springs. Hog-ringing is a conventional means of attaching fabric or padding to an innerspring construction, although other mechanical or adhesive means may be used.

Figure 2:
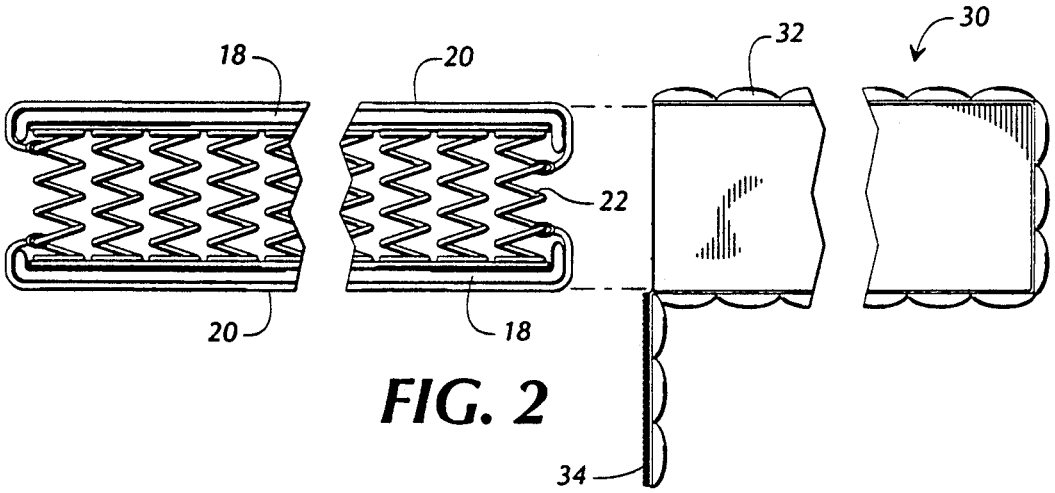
FIG. 2 is an end, assembled view of the above elements, plus a removable cover detached therefrom.

After the barrier material 20 and upholstery layers 18 are in place, the innerspring construction may then be conventionally upholstered (not shown), or a removable cover 30 may be placed on the innerspring constructions, as shown in FIG. 2.

This removable cover 30 may be composed of conventional upholstery material 32 such as is used in conventional non-removable mattress covers, and may be secured in place by closing a zipper to secure a lid 34 to provide a complete enclosure of the innerspring construction and barrier material. Hook-and-loop fasteners may also be used if desired.

As may be understood, if a mattress encounters a liquid spill on, for example, its top surface, the liquid will tend (if conventional upholstery is used) to seep into the upholstery. If the spillage is large enough, the liquid may seep entirely through the cover and encounter the barrier layer. At that point it preferably will be stopped or at least impeded. As may be understood, this is desirable in that the springs of the mattress are not soiled, which as discussed above is disadvantageous in that the springs and padding layers are difficult to clean or even to access, especially in the case of pocketed coils.

Figure 3:
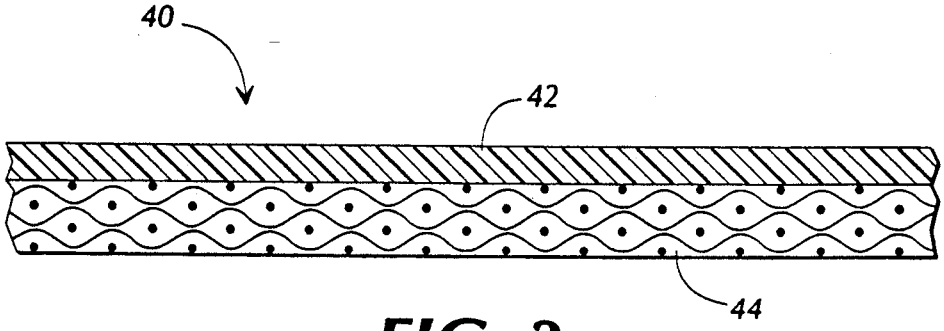
FIG. 3 is an isolated cross-sectional view of a laminated barrier layer according to the present invention.
Figure 4:
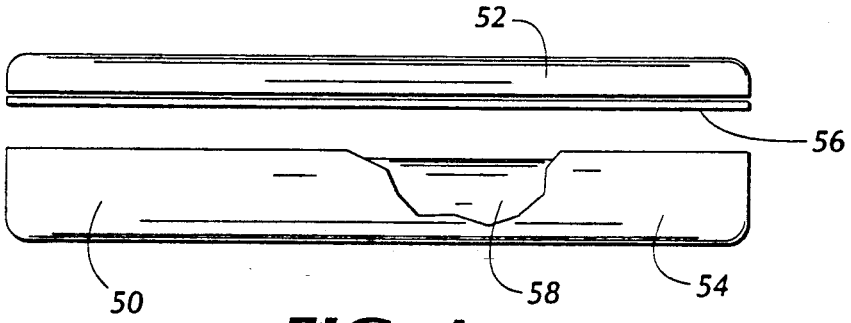
FIG. 4 is a side, exploded view of a water mattress according to the present invention.

Referring now to FIG. 3, the composition of the barrier layer 40 is now discussed. In the embodiment shown, the barrier layer 40 is a 2-part laminated construction, with a liquid-resistant layer 42 laminated or otherwise attached to a structural backing layer 44. In the embodiment illustrated in FIG. 3, the liquid-resistant layer 42 is vinyl, namely 3 mil, 87" wide, monomeric polyvinyl chloride formulated to meet California Administration Code Title 19, which is the vertical flame requirement. The vinyl also has a anti-microbial agent additive. Other thicknesses of vinyl, including 2–5 mils, or other moisture-impervious material, could also be used.

The structural backing layer 44 in the embodiment illustrated in FIG. 3 is a non-woven polypropylene fabric consisting essentially of a corded web of staple fibers which are bonded to form a fabric of substantially uniform thickness throughout and of substantially uniform strength. The particular material used is MERGE L17307 manufactured by Phillips Fibers, Inc., which weighs approximately 2.3 ounces per square yard. However, it is thought that a range of 1.5–3.0 ounces per square yard could also be used, and other nonwoven or woven products could be used. Tearing resistance and flexibility are primary concerns for this fabric.

Woven material could be used, although cost may be a factor.

The lamination process consists of the application of adhesive off a drum roller onto the structural backing layer 44. The vinyl is then laid on the structural backing layer 44 and sent through a pressure roller heat process. The material is brought to 300 degrees F. and 4000 P.S.I. is applied.

It may be understood that alternatives exist in constructing the 2-part layer illustrated in FIG. 3. One alternative is to use adhesive only. Another alternative is to attach the layers by heat and pressure only. Another alternative is to use heat only.

The laminated water resistant barrier layer 56 may also be sewn into the top cover portion 52 of a water mattress 50, to provide a barrier to water or moisture which may escape from the inner water bladder(s) 58 within the mattress 50. The construction of the water resistant layer 56 readily accommodates such sewing, with improved resistance to tearing or ripping even after sewing.

Figure 5:
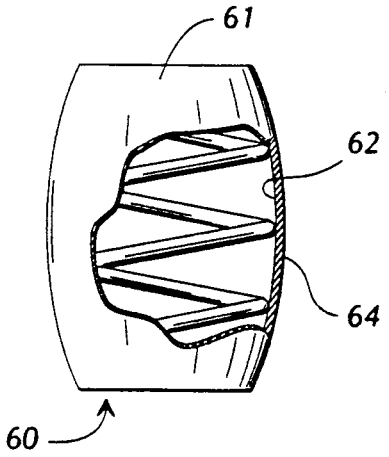
FIG. 5 is a partial cutaway view of the side of a pocketed coil according to the present invention.

As seen in FIG. 5, an improved pocketed coil construction 60 is also provided under the present invention. This pocketed coil construction 60 includes a spring 61 which is encased in a 2-ply fabric cover (as set forth in U.S. Pat. No. 4,234,933 to Stumpf). This 2-ply laminated barrier material (shown as 40 in FIG. 3) includes an exterior water- or moisture-impervious layer 64 laminated to a structural backing layer 62 which may be a woven- or non-woven fabric.

In this construction 60, it may be seen that the encased spring 61, typically made of metal, is protected by the moisture barrier.

It should be understood that the fabric on the springs could also be reversed, i.e., the structural backing layer is on the outside.

It should also be understood that foam, plastic springs, or other resilient material, could also be used as a substitute for metal innerspring constructions.

Therefore, it may be seen that a mattress construction is provided which provides improved resistance to soiling by water, water vapor, or other liquids or vapors. An improved water mattress construction is also provided which reduces the chances of leakage of the interior water.

While this invention has been described in specific detail with reference to the disclosed embodiments, it will be understood that many variations and modifications may be effected within the spirit and scope of the invention as described in the appended claims.

What is claimed is:

1. A mattress construction, comprising:

a) an innerspring construction defining an upper primary surface and including at least one spring;

b) a laminated liquid-resistant barrier layer for discouraging liquid passage, said barrier layer itself comprising:

a liquid impervious layer for discouraging liquid passage; and a structural backing layer comprised on nonwoven polypropylene fibers, said structural backing layer attached permanently to said liquid impervious layer;

c) attachment means for attaching said laminated liquid-resistant layer to said innerspring construction such that said laminated liquid-resistant layer is positioned adjacent said upper primary surface of said innerspring construction; and d) a removable cover.

2. The mattress as claimed in claim 1, further comprising a padding layer intermediate said laminated liquid-resistant barrier layer and said innerspring construction.

3. The mattress as claimed in claim 1, wherein said liquid impervious layer is vinyl.

4. The mattress as claimed in claim 3, wherein said liquid impervious layer is 3 mil vinyl.

5. The mattress as claimed in claim 1, wherein said attachment means are hog rings.

6. A mattress construction, comprising:

a) an innerspring construction defining an upper primary planar surface and including at least one spring;

b) a laminated liquid barrier layer for discouraging liquid passage, said barrier layer itself comprising:
a liquid resistant layer for discouraging liquid passage; and
a structural backing layer in planar contact with and permanently attached to said liquid resistant layer;

c) attachment means for attaching said structural backing layer of said laminated liquid barrier layer to said innerspring construction such that attachment of said structural backing layer causes said liquid resistant layer to be likewise attached relative to said innerspring construction and whereby the presence of said structural backing layer tends to reduce tearing of said liquid impervious layer caused by said attachment means, and d) a cover.

7. The mattress as claimed in claim 6, wherein said attachment means for attaching said structural backing layer of said laminated liquid barrier layer to said innerspring construction is at least one hog ring which extends through said structural backing layer.

8. The mattress as claimed in claim 6, wherein said liquid-resistant layer is vinyl.

9. The mattress as claimed in claim 8, wherein said liquid-resistant layer is vinyl of approximately 3 mils in thickness.

10. The mattress as claimed in claim 8, wherein said structural backing layer is a non-woven polypropylene fabric layer.

11. The mattress as claimed in claim 6, wherein said structural backing layer is a non-woven polypropylene fabric layer.

12. The mattress as claimed in claim 6, wherein said attachment of said structural backing layer and said laminated liquid layer is provided by adhesive.

13. The mattress as claimed in claim 6, wherein said attachment of said structural backing layer and said laminated liquid layer is provided by heat bonding.

14. The mattress as claimed in claim 6, wherein said attachment of said structural backing layer and said laminated liquid layer is provided by adhesive and heat bonding.

15. The mattress as claimed in claim 6, wherein said cover is an upholstery cover.

16. The mattress as claimed in claim 6, wherein said cover is removable.

17. The mattress as claimed in claim 6, wherein said liquid-resistant layer is vinyl, wherein said structural backing layer is a non-woven polypropylene fabric layer, wherein said attachment means for attaching said structural backing layer of said laminated liquid barrier layer to said innerspring construction is at least one hog ring which extends through said structural backing layer and said non-woven polypropylene fabric layer, and wherein said cover is an upholstery cover.

* * * * *